US005690425A

United States Patent [19]

Knoll, Jr.

[11] Patent Number: 5,690,425

[45] Date of Patent: Nov. 25, 1997

[54] PROTECTIVE GUARD ASSEMBLY

[76] Inventor: D. Robert Knoll, Jr., 112 Fugate Dr., Cumberland, Ky. 40823

[21] Appl. No.: 427,946

[22] Filed: Apr. 24, 1995

[51] Int. Cl.[6] ..... F21V 15/00

[52] U.S. Cl. ..... 362/376; 362/378

[58] Field of Search ..... 362/376, 378, 362/399, 400

[56] References Cited

U.S. PATENT DOCUMENTS

| | | | |
|---|---|---|---|
| D. 163,742 | 6/1951 | Bogaerts | D48/24 |
| D. 244,561 | 5/1977 | Dacal | D48/20 E |
| D. 244,794 | 6/1977 | Dacal | D48/20 E |
| D. 250,289 | 11/1978 | Dacal | D48/20 E |
| 1,057,409 | 4/1913 | Buchanan . | |
| 2,534,992 | 12/1950 | Reid . | |
| 4,344,114 | 8/1982 | Denhart | 362/147 |
| 4,438,484 | 3/1984 | Winden | 362/267 |
| 5,369,559 | 11/1994 | Hedrick et al. | 362/376 |

*Primary Examiner*—Stephen F. Husar
*Attorney, Agent, or Firm*—King and Schickli

[57] ABSTRACT

Protective guard assemblies for light fixtures are designed especially for use in industrial environments, such as underground mining operations. Each assembly includes a reinforced cap and a base to which the light fixture is secured. The cap is installed over the fixture and secured to opposing sides of the base by hinges formed of mating sleeves. The base includes a cable support flange at one end. The support flange has two semi-circular notches on which the electrical cables are cradled to protect them from being damaged by outside impact. The cap includes a rear end plate with mating inverted semi-circular notches. With the cap installed on the base, the mating notches in the cap and base form circular apertures that firmly engage the two cables. The cap also includes a C-shaped hood extending from the rear end plate and over the cables and support flange to provide additional protection from outside impact.

10 Claims, 2 Drawing Sheets

PROTECTIVE GUARD ASSEMBLY

TECHNICAL FIELD

The present invention relates generally to a protective guard assembly for a lighting fixture; and more particularly, to an improved light guard assembly having a heavy-duty construction and including cable protection features for supporting and shielding the incoming electrical cables from potentially damaging outside contact.

BACKGROUND OF THE INVENTION

The need for heavy-duty lighting fixtures in harsh industrial environments is well established. One such environment having particularly unfavorable conditions is an underground mining operation. In a mining operation, lighting fixtures must operate in severely restricted spaces alongside large material handling and moving equipment, roof bolting machines, support timbers, roof jacking devices and the mining machines themselves. This equipment is constantly working on the mineral face and moving the mined material out of the mine.

This constant operation of this equipment and the removal and transport of large volumes of aggregate material, such as rock, coal or the like, is necessarily rough on the equipment. Because of the relatively narrow passages, the wet surface upon which the equipment is operating and other factors, there is a relatively frequent occurrence of collisions with the wall of the mine and bumps against other equipment in the area. Thus, light fixtures in the mine are particularly vulnerable to being broken or damaged.

The United States Bureau of Mines (USBM) regulates and certifies the equipment used in underground mining operations. Among the regulations for lighting in underground mines are provisions relating to the mounting of light fixtures, the minimum illumination required for particular areas and specific requirements addressing the cable entry sections of the light fixtures. Thus, only specially designed light fixtures with specific constructions conforming to the United States Bureau of Mines (USBM) regulations may be used in an underground mine. Such fixtures must serve the dual functions of protecting the enclosed light source from damage while simultaneously allowing sufficient light to propagate from the enclosure to adequately illuminate the surrounding area.

The USBM regulations also authorize stiff monetary fines and/or other sanctions imposed by inspectors when lighting equipment is found damaged or otherwise fails to meet the applicable standards. For example, each violation of a regulation governing the integrity of the cable entry section of a light fixture results in a $1,000 fine for the mine operator. This type of violation commonly occurs when there is an inadvertent collision that damages the cable entry section or the cables themselves.

The typical light fixture that is used in an underground mining operation is, of course, designed and constructed to meet the standards of the USBM. Nevertheless, a common complaint within the mining industry concerns the frequency with which fixtures are damaged and/or destroyed by inadvertent contact. In the typical mining light fixture, the incandescent or fluorescent bulb is enclosed in a box-shaped casing that includes transparent windows to allow the light to be distributed. The casing framework is constructed of a high-strength, durable material such as cast aluminum. Groups of lights in a particular area are often connected in parallel, so that the cable entry section of a light fixture includes two tubular connectors or stub conduits. These connectors protrude from a flat vertical plate at one end of the fixture and are elevated to ease the connection of the cables.

The connectors and the vertical end plate form substantially a right angle, with the connectors being completely exposed to outside contact from all directions. It follows that the cable entry section of the fixture is extremely vulnerable to inadvertent contact or impact that can bend, or even break the connectors and/or tend to cut the cables themselves. The typical light fixture design also leaves exposed the transparent windows of the enclosure, thereby subjecting them to direct impact that leads to breaks and/or cracks. Any such damage that is not repaired leads to a citation and a fine.

Furthermore, as many types of damage cannot be repaired in the field, the mine operator often is forced to either return the fixture to the manufacturer for repair or purchase an entirely new fixture. These repair/replacement costs, in addition to the substantial fines for damaged equipment, can rapidly add up to prohibitively large losses, especially for a small-scale operation.

Thus, as demonstrated by the limitations of the prior art, there is a need identified for a protective guard assembly that is specifically designed for enclosing light fixtures to shield them from outside impact, with particular features directed to protecting the cable entry section of the light fixture. The guard assembly should also be specifically designed to allow the full propagation of light from the fixture to adequately illuminate the surrounding area, while simultaneously providing easy access to the enclosed fixture for convenient maintenance.

SUMMARY OF THE INVENTION

In accordance with the purposes of the present invention as described herein, a novel and improved protective guard assembly is provided for shielding a light fixture from outside impact. The assembly is particularly designed for use in severe industrial environments, such as underground mining operations.

The protective guard assembly of the present invention includes a flat, rectangular base on which the light fixture is mounted, and a reinforced cap enclosing the fixture and secured to the base. The fixture typically receives two cables that include two conductors each at a cable entry section, with one cable powering the light source and the other leading to a separate fixture that is connected in parallel. In an important aspect of the present invention, the base of the assembly includes cable protection means adjacent to the cable entry section of the light fixture. In the preferred embodiment, the cable protection means comprises a cable support flange that extends substantially perpendicularly from the base and includes an entry port formed by two semi-circular notches on which the cables rest and two mating notches on the cap of the guard assembly. The support flange may be either rigidly affixed to the base or pivotally secured by a standard hinge. The latter pivotal connection allows convenient access to the lower portion of the cable entry section of the fixture.

Advantageously, the cable support flange provides critical support to the cables upon impact to the cables and/or the cable entry section of the fixture. This support significantly reduces the possible damage to the cables and the fixture, as the support flange resists the moment arm and resulting sheering forces created by an object impacting the cables a short distance from the cable entry section.

The reinforced cap substantially encloses and shields the light fixture from outside impact, and provides additional protection for the cable entry section. In the preferred embodiment, the cap includes three rectangular apertures to allow illumination to propagate. At the rear/cable entry portion of the cap is a rear end plate having a cut-out that substantially conforms to the shape of the cable support flange. Preferably, the cut-out and mating support flange have an angled wedge shape that makes the cap self-aligning with the base and provides clearance to allow the cap to be pivoted upwardly/outwardly about one side of the base. The two notches on the rear end plate engage the cables directly opposite the notches in the cable support flange and firmly grip the cables. In this manner, the two sets of semi-circular notches mate to form the circular entry ports that isolate and protect the cables substantially around their entire peripheries.

To provide additional protection for the cable entry section of the light fixture, a hood extends outwardly from the rear end plate. The hood is comprised of three elongated shield plates that are affixed end-to-end to form substantially a C-shape. The shield plates are secured to the rear end plate such that they extend over and along each side of the cables. In this manner, the shield plates advantageously form the C-shaped hood that protects the cable entry section, the cables and the tubular connectors from outside impact on three sides.

A variety of fastener means may be used to secure the reinforced cap to the base. In the preferred embodiment, the cap is secured to opposing sides of the base by full-length hinges formed by mating cylindrical sleeves and an elongated pin or dowel extending through the sleeves. More specifically, each hinge is comprised of dual side sleeves that are spaced apart and affixed to the lower edges of the cap at its front and rear portions. A corresponding elongated base sleeve is mounted on opposing sides of the base. In this manner, when the cap is installed on the base, each pair of side sleeves is aligned colinearly with the corresponding base sleeve to form a full-length hinge on each side of the base/cap. The elongated pin is then inserted into each hinge, with the pin having one end bent in an L-shape and the other end including a cross aperture through which a cotter key is inserted to retain the dowel in the hinge.

Advantageously, incorporating a full-length hinge on each side of the assembly serves two important functions: (1) securely retaining the cap on the base, and (2) allowing quick and easy access to the enclosed light fixture. Providing full-length retention on both sides of the assembly insures that the cap remains in place, even when subject to the most severe impacts. As for gaining access to the fixture, only one dowel need be removed, and the cap is easily pivoted upwardly and away from the enclosed light fixture about the opposing hinge. Furthermore, the protective cap remains attached to the base while maintenance on the enclosed fixture is performed, thereby providing for quick and simple service by mine personnel.

Several embodiments of the protective guard assembly of the present invention are disclosed, with each embodiment having features corresponding to the particular design of light fixture being used. In the preferred embodiment of the present invention, the reinforced cap includes an end plate at the front portion of the cap opposite the rear cable entry section of the fixture. The upper corners of the front end plate are connected to the upper corners of the rear end plate by two parallel bars that extend along the length of the cap. At the front and rear portions of the cap, a top plate extends between the parallel bars, while rectangular side plates depend downwardly from each bar. One longitudinal edge of each top and side plate is affixed to the adjacent edge of the front or rear end plate.

With this construction, the cap and base cooperate to define three rectangular apertures that allow illumination from the enclosed light fixture to propagate from three sides of the cap. Additionally, if desired, the front end plate is provided with a circular cut-out to allow access to the enclosed light fixture while the reinforced cap remains fully secured to the base.

In another embodiment of the present invention, the reinforced cap includes fully extending side and top plates such that the cap and base together form a box that is substantially enclosed on five sides. With this construction, complete protection from outside impact is provided on these five sides of the fixture while illumination propagates from the sixth side. This embodiment is particularly well-suited for headlights and other lighting fixtures that provide light from only one side.

The base, reinforced cap and other components of the present invention are preferably fabricated from high strength mild steel, with the various plates having a ¼ to ⅜ inch thickness, and all connections are performed by welding. However, within the broader aspects of the present invention, different thicknesses, other sufficiently durable materials and different methods of connection can be used.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1A:
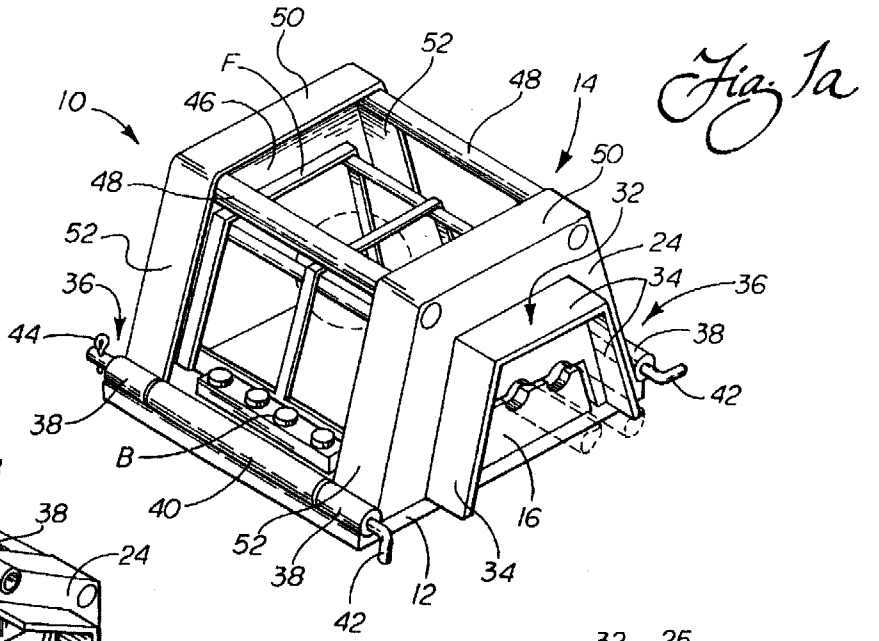
FIG. 1*a* is a perspective view of the guard assembly showing the reinforced cap installed over the light fixture and secured to the base, with the electrical cables shown in dash-dot outline.
Figure 1:
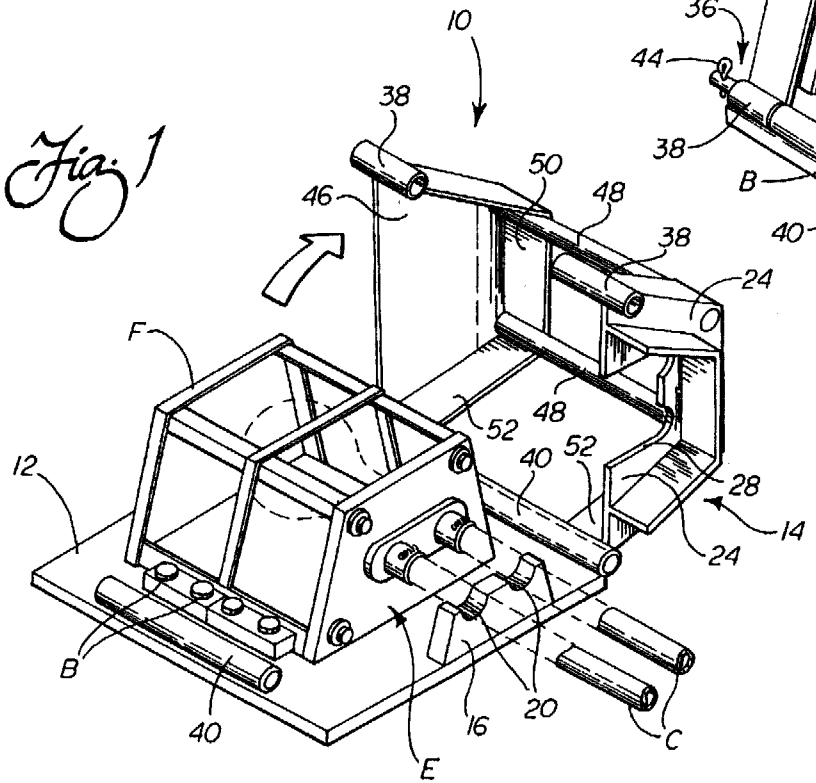
FIG. 1 is a perspective view of a protective guard assembly of the present invention showing the reinforced cap being rotated about one of the full-length hinges to expose the enclosed light fixture.

Reference is now made to FIGS. 1 and 1*a* of the drawings showing the preferred embodiment of an improved protective guard assembly according to the present invention, and generally represented by the reference numeral 10. The assembly 10 is particularly adapted for enclosing and protecting a light fixture in a severe industrial environment where impact loadings from outside objects are frequent, and more specifically is adapted for use in underground mining operations.

The protective guard assembly 10 is comprised of a flat, rectangular base 12 and a reinforced cap, generally represented by the reference numeral 14, that is secured to the base. A light fixture F is affixed to the base 12 by any suitable means, such as bolts B, and the cap 14 is installed over the fixture F. The base 12 is secured to the wall of the mine shaft or passageway, such as on a structural support member, or to a piece of equipment in the area of the mine requiring illumination.

The fixture F typically has a rectangular or trapezoidal cross section, and the size and shape of the cap 14 and base 12 may be varied according to the particular fixture being used, as is discussed in more detail below. As best seen in FIG. 1, the fixture F typically includes a cable entry section, generally represented by the reference letter E. The cable entry section E receives two cables C, with one cable providing power to the enclosed light and the other leading to a separate fixture that is connected in parallel.

Figure 2:
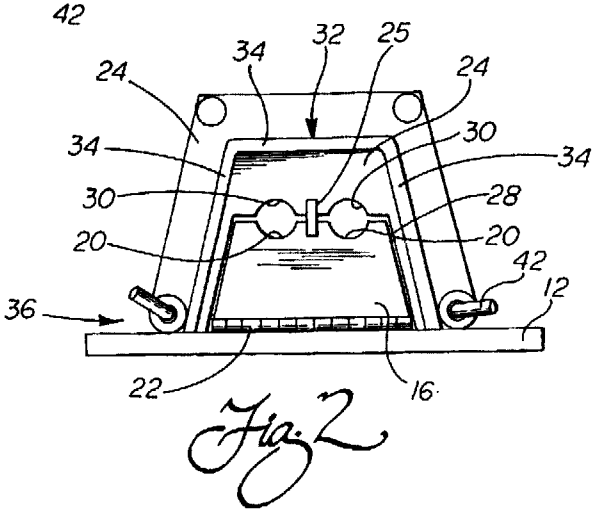
FIG. 2 is an end view of the protective guard assembly with the reinforced cap installed on the base, and showing the cable support flange being pivotally connected to the base with a standard hinge.

In accordance with an important aspect of the present invention, the base 12 of the assembly 10 includes cable protection means adjacent to the cable entry section E of the fixture F. Preferably, the cable protection means comprises a cable support flange 16 that projects substantially perpendicularly from the base 12. As shown in FIGS. 1 and 1*a*, the support flange 16 is rigidly affixed to the base, such as by welding. Alternatively, as illustrated in FIG. 2, the support flange 16 may be pivotally secured to the base 12 by a hinge 22. With a pivotal connection, the cable support flange 16 may be conveniently rotated downwardly to allow access to that portion of the cable entry section E directly below the incoming cables C. In this raised or operative position the flange 16 is retained by the engagement of its lower edge against the base 12 and the depending tab 25 fixed to the plate 24 (see FIG. 2). This type of free access is particularly important with those light fixtures having bolts in the lower portion of the cable entry section that must be removed to gain access to the enclosed bulb. By first pivoting the cap 14 away from the fixture F (see FIG. 1), and then rotating the cable support flange 16 downwardly, a maintenance worker can access these bolts and change the enclosed bulb without having to remove the entire fixture from the base 12.

The upper edge of the support flange 16 includes two semi-circular notches 20 that cradle the cables C from below. Advantageously, this flange 16 provides critical support to the cables C when an outside object or other force impacts the cable at or near this critical point. This support significantly reduces the possible damage to the cables C by substantially eliminating any impact sheer force adjacent the cable entry connectors of the section E. Additionally, the cable support flange 16 simplifies the installation of the cables C by acting as a resting cradle and guide as the cables are inserted into the fixture F during installation.

To protect the main body of the fixture F from outside impact, and to provide additional protection for the cables C and the section E, the reinforced cap 14 fits entirely over the fixture F and is secured to the base 12. In the preferred embodiment shown in FIG. 1*a*, the cap 14 substantially surrounds the entire fixture F and includes three rectangular apertures to allow illumination to propagate to the interior of the mine, or other enclosed space.

As best seen in FIGS. 1 and 2, a rear end plate 24 includes a cut-out 28 that substantially conforms to the shape of the cable support flange 16. In the preferred embodiment shown in FIGS. 1 and 2, the cut-out 28 and matching support flange 16 have an angled wedge shape that makes the cap 14 self-aligning with the base 12. Additionally, as will be discussed in more detail below, the wedge shape provides clearance for the cap 14 to pivot upwardly/outwardly about one side of the base 12 to provide easy and convenient access to the enclosed fixture F.

As best shown in FIG. 2, the rear end plate 24 includes two inverted semi-circular notches 30 that engage the top half of the cables C (not shown in this figure) directly opposite the cable support flange notches 20. In this manner, the two pairs of notches 20, 30 mate to form fully circular ports or apertures that surround and firmly support the entire peripheries of the cables C. This full-circumference protection provides superior support and impact resistance to both the cables C and the adjacent cable entry section E of the fixture F. As mentioned above, when the cable support flange 16 is mounted to the base 12 by the hinge 22, the rear end plate 24 includes a fixed alignment tab 25 positioned between the inverted notches 30. As shown in FIG. 2, with the cable support flange 16 raised to a vertical position, the tab 25 extends downwardly to capture the support flange 16 and prevent it from pivoting downwardly.

To provide supplemental protection for the cables C and the cable entry section E, a C-shaped hood, generally designated by the reference numeral 32, extends from the rear end plate 24. The hood includes three elongated shield plates 34 that are joined end-to-end and are secured to the rear end plate 24 along a common angled edge. The hood 32, by extending over and along each side of the cable support flange 16, advantageously deflects any objects that would otherwise impact the cables C and/or the connectors on the section E of the fixture F.

Within the broader aspects of the present invention, any suitable fastener means may be used to secure the reinforced cap 14 to the base 12. Preferably, the cap 14 is releasably secured to the base 12 to allow access to the enclosed light fixture F for repairs and maintenance. As illustrated in FIG. 1*a*, in the preferred embodiment the cap 14 is secured to opposing sides of the base 12 by a full length hinges 36. Each full length hinge 36 is formed by dual cylindrical side sleeves 38 positioned at the front and rear portions of the cap 14 and mating with a corresponding elongated base sleeve 40. With the cap 14 installed on the base 12, each pair of side sleeves 38 is aligned colinearly with the corresponding base sleeve 40 to form a full length hinge 36 on each side of the guard assembly 10. An elongated hinge pin or dowel 42 extends through each full length hinge 36 and includes a cotter key 44 at one end to retain the pin in the hinge.

Advantageously, the dual hinges 36 provide maximum retention of the cap 14 to the base 12 by positively securing the cap along the full length of each side of the base. In this manner, the cap 14 remains installed on the base 12 even under the most extreme and severe loadings. Additionally, in a further important aspect of the present invention, the hinges 36 allow quick and easy access to the enclosed light fixture F. Access is gained by simply removing the pin 42 from one hinge 36 and pivoting the cap 14 upwardly and away from the fixture F about the opposing hinge (see FIG. 1). Furthermore, the hinges 36 allow the cap 14 to remain attached to the base 12 while maintenance or repairs are performed on the enclosed fixture F. Thus, repositioning of the cap 14 is similarly convenient and fast. It should be appreciated that the easy access and repositioning features of the guard assembly 10 are of particular importance to allow routine maintenance, such as changing burned out bulbs.

Numerous types and sizes of light fixtures are commonly used in the underground mining industry and in other similar operations. Accordingly, as indicated above the present invention in its broadest aspect encompasses various embodiments of the protective guard assembly 10, with each embodiment having features corresponding to a particular design of fixture. In the preferred embodiment of the invention shown in FIGS. 1, 1*a* and 2, in addition to the components previously identified, the reinforced cap 14 includes a front end plate 46. Two parallel bars 48 extend along the length of the cap 14 and join the upper corners of the front and rear end plates 46, 24. To provide structural support, a rectangular top plate 50 extends between the parallel bars 48 at the front and rear portions of the cap 14. One longitudinal edge of each top plate 50 is affixed to the adjacent horizontal edge of the front or rear end plate 46, 24. Side plates 52 depend from each bar 48, with the bottom edge affixed to the corresponding side sleeves 38 of the hinges 36. As with the top plates 50, one longitudinal edge of each side plate 52 is affixed to the adjacent edge of the front and rear end plates 46, 24.

In this embodiment, the construction of the cap 14 defines three rectangular apertures that allow illumination from the enclosed light fixture F to propagate from three sides for maximum lighting of the surrounding areas. Advantageously, the protective guard 10 provides superior protection for the enclosed fixture F while simultaneously allowing full lighting to satisfy USBM regulations.

Figure 3:
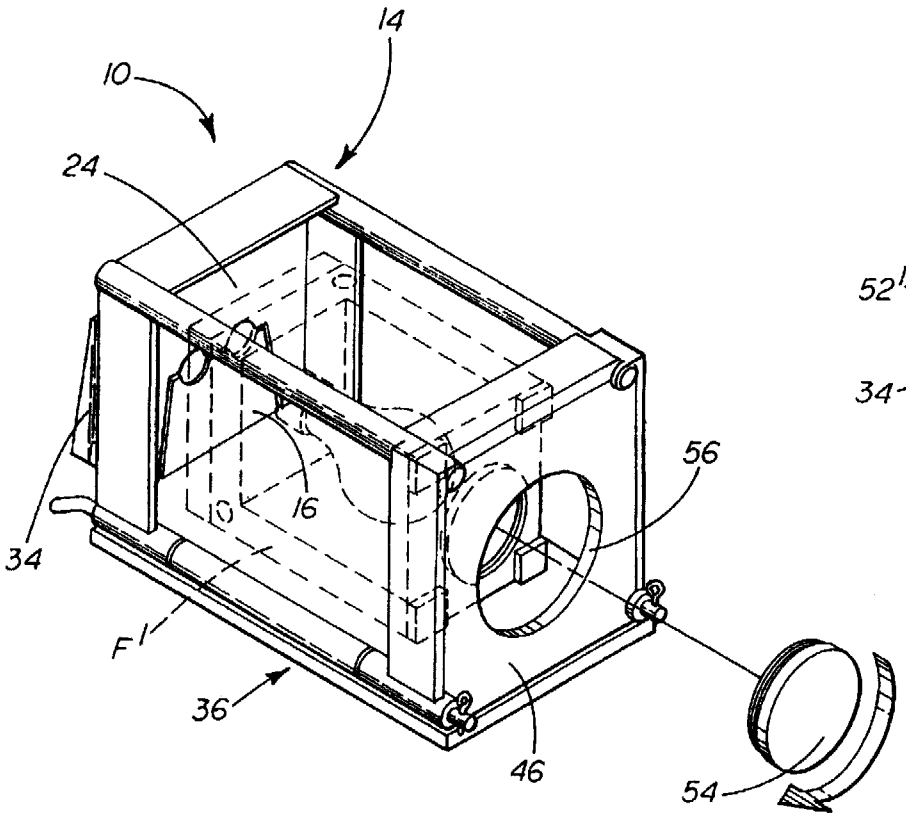
FIG. 3 is a perspective view of the guard assembly showing a circular cut-out in the front end plate of the reinforced cap, and showing a threaded end plug removed from the fixture to allow access to the enclosed light bulb.

As illustrated in FIG. 3, where a light fixture F' includes a threaded end cap 54 for access to the enclosed bulb, the front end plate 46 of the cap 14 includes a circular cut out 56 adjacent to the threaded end cap 54. Advantageously, the cut out 56 allows access to the enclosed fixture F' while the cap 14 remains fully installed on the base 12. With this construction, a burned out bulb of the fixture F' may be changed simply by reaching through the circular cut out 56 to unscrew the end cap 54 and removing the enclosed bulb.

It is noted that another difference inherent in the FIG. 3 embodiment is that the cross section of the guard assembly 10 (and its cap 14) is rectangular (specifically square), rather than being trapezoidal in shape, as in the FIG. 1, 1*a*, 2 embodiment. This feature of the invention is simply to preferably make the guard assembly 10 to match the general profile of the fixture F or F'.

Figure 4:
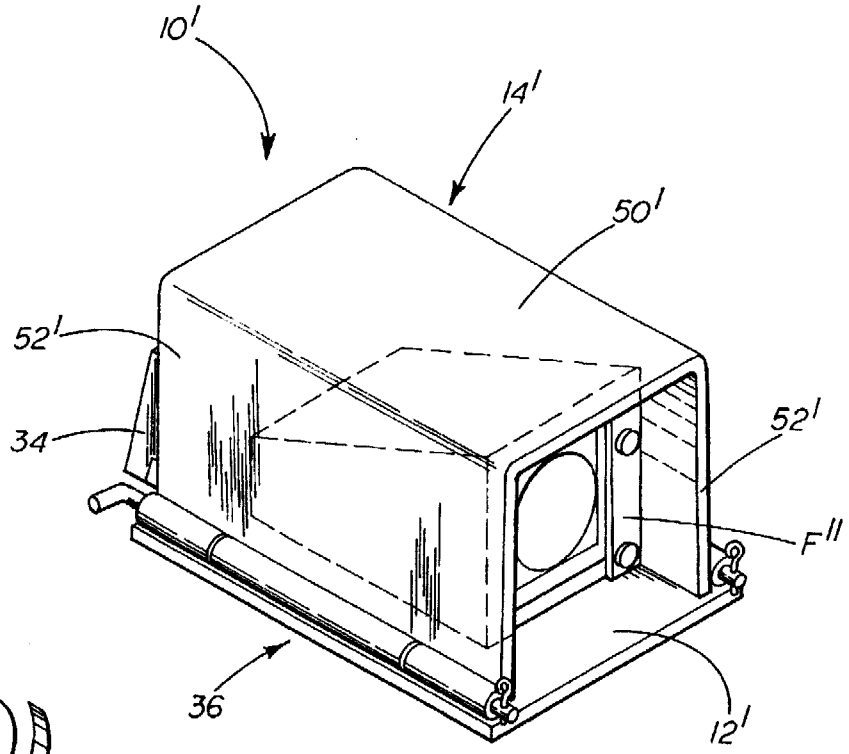
FIG. 4 is a perspective view of an alternative embodiment of the guard assembly of the present invention in which the reinforced cap includes continuous top and side plates, such that the cap and base completely enclose the light fixture on five sides with the front portion of the cap left open to allow light to propagate.

In the alternative embodiment shown in FIG. 4, a guard assembly 10' surrounds and generally matches another fixture F" and includes a reinforced cap 14' with fully extending top and side plates 50', 52'. In this embodiment, when the cap 14' is secured to the base 12', the fixture F" is substantially completely enclosed on 5 sides, with only the front portion of the assembly 10' being open to allow light to propagate. Thus, the assembly 10' provides complete protection from outside impact on five sides of the fixture F", and is particularly well suited for headlights and other fixtures that distribute light from only one end.

The base 12, reinforced cap 14 and other components of the present invention are preferably fabricated from high strength mild steel. The various plates of the reinforced cap 14 preferably have a thickness of ¼ to ⅜ inch, and all connections are made by welding. However, it should be appreciated that within the broader aspects of the present invention, various other thicknesses of steel and other suitable materials, such as high impact plastic, as well as different methods of fabrication, such as casting, can be used.

The foregoing description of a preferred embodiment of the invention has been presented for purposes of illustration and description. It is not intended to be exhaustive or to limit the invention to the precise form disclosed. Obvious modifications or variations are possible in light of the above teachings. The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A protective guard assembly for a light fixture, said light fixture receiving and being powered by at least one cable, said protective guard assembly comprising:

a base mounting said light fixture;

a reinforced cap substantially surrounding said fixture and including at least one aperture to allow illumination from said light fixture to propagate from said cap;

cable protection means adjacent one end of said base and including a cable support flange extending substantially perpendicularly from said one end of said base; and fastener means fastening said cap to said base;

wherein said cap includes a rear end plate having a cut-out substantially conforming to the shape of said cable support flange, whereby said cable support flange cooperates with said rear end plate to support said cable substantially around its entire periphery when said cap is fastened to said base.

2. The protective guard assembly of claim 1, wherein said cut-out and said cable support flange have an angled wedge shape that allows said cap to freely pivot away from said base.

3. The protective guard assembly of claim 1, wherein said cable protection means includes a hood extending outwardly from said rear end plate to shield said cable from outside impact.

4. The protective guard assembly of claim 3, wherein said hood comprises three elongated shield plates affixed end-to-end to form a C-shape, said shield plates secured to said rear end plate along a common angled edge.

5. The protective guard assembly of claim 1, wherein said cable support flange includes a first semi-circular notch engaging said cable.

6. The protective guard assembly of claim 5, wherein said rear end plate includes a second semi-circular notch engaging said cable directly opposite said first notch and mating with said first notch such that said cable is supported around substantially its entire periphery.

7. A protective guard assembly for a light fixture, said light fixture receiving and being powered by at least one cable, said protective guard assembly comprising:

a base mounting said light fixture;

a reinforced cap substantially surrounding said fixture and including at least one aperture to allow illumination from said light fixture to propagate from said cap;

cable protection means adjacent one end of said base; and fastener means fastening said cap to said base;

wherein said base and said cap form a box substantially enclosed on five sides, said box allowing illumination from said light fixture to propagate from a sixth side.

8. A protective guard assembly for a light fixture, said light fixture receiving and being powered by at least one cable, said protective guard assembly comprising:

a base mounting said light fixture;

a reinforced cap substantially surrounding said fixture and including at least one aperture to allow illumination from said light fixture to propagate from said cap;

cable protection means adjacent one end of said base;

fastener means fastening said cap to said base;

said cap further including:

a front and a rear portion;

a front end plate spaced longitudinally from a rear end plate and engaging said base at substantially a right angle;

two parallel bars connecting upper corners of said front and rear end plates;

a rectangular top plate extending between said parallel bars at said front and rear portions of said cap; and side plates depending downwardly from said parallel bars at said front and rear portions of said cap;

each of said top and side plates including an aperture allowing illumination from said fixture to propagate from at least three sides of said cap.

9. The protective guard assembly of claim 8, wherein said front end plate includes a cut-out to allow access to said light fixture while said cap remains secured to said base.

10. The protective guard assembly of claim 8, wherein said fastener means comprises:

dual side sleeves affixed to said side plates at said front and rear portions of said cap and adjacent the bottom edge;

an elongated base sleeve on opposing sides of said base, said base sleeve aligned colinearly with said side sleeves when said cap is secured to said base; and an elongated pin extending through each of said colinearly aligned side and base sleeves, whereby access to said light fixture may be gained by removing one pin and pivoting said cap upwardly and away from said light fixture about the other pin.

* * * * *